US006112822A

United States Patent [19]

Robin et al.

[11] Patent Number: 6,112,822

[45] Date of Patent: Sep. 5, 2000

[54] METHOD FOR DELIVERING A FIRE SUPPRESSION COMPOSITION TO A HAZARD

[76] Inventors: Mark L. Robin, 5411 Hillside La., Otterbein, Ind. 47970; W. Douglas Register, 70 Mill Dr.; Yuichi Iikubo, 2825 Barlow, both of West Lafayette, Ind. 47906; Mark A. Sweval, 1226 Old Mill La., Lafayette, Ind. 47905

[21] Appl. No.: 09/261,535

[22] Filed: Mar. 3, 1999

Related U.S. Application Data

[63] Continuation of application No. 08/811,336, Mar. 4, 1997, abandoned, which is a continuation of application No. 08/383,059, Feb. 3, 1995, abandoned.

[51] Int. Cl.[7] ..... A62C 31/00; A62C 35/02

[52] U.S. Cl. ..... 169/46; 169/9; 169/85

[58] Field of Search ..... 169/5, 9, 46, 47, 169/71, 84, 85, 86, 87, 88

[56] References Cited

U.S. PATENT DOCUMENTS

| | | | |
|---|---|---|---|
| 1,501,956 | 7/1924 | Loepsinger | 169/9 |
| 4,319,640 | 3/1982 | Brobeil | 169/9 X |
| 4,520,871 | 6/1985 | Miller et al. | 169/9 X |
| 4,531,588 | 7/1985 | Brünsicke | 169/9 |
| 5,124,053 | 6/1992 | Iikubo et al. | 169/46 X |
| 5,449,041 | 9/1995 | Galbraith | 169/9 X |

FOREIGN PATENT DOCUMENTS

| | | |
|---|---|---|
| 0 711 578 A2 | 5/1996 | European Pat. Off. . |
| 214560 | 4/1998 | Hungary . |
| 1319868 A1 | 6/1987 | U.S.S.R. . |

OTHER PUBLICATIONS

NFPA 12A,Standard on Halon 1301 Fire Extinguishing System, 1989 Edition, pp. 12A–1, 12A–32.

NFPA 2001, Standard on Clean Agent Fire Extinguishing Systems, 1999 Edition, (Sep. 1, 1998) pp. 96–98.

DiNenno, et al., "Design and Engineering Aspects of Halon Replacements", Process Safety Progress (vol. 14, No. 1—Jan. 1995), pp. 57–62.

*Primary Examiner*—Andres Kashnikow

*Attorney, Agent, or Firm*—Marshall, O'Toole, Gerstein, Murray & Borun

[57] ABSTRACT

A method for delivering a liquid fire suppression composition to a fire includes storing the fire suppression composition and a pressurized gas in separate containers, detecting the occurrence of a fire to be suppressed, within about 60 seconds of detecting the fire coupling the pressurized gas with the fire suppression composition to superpressurize the composition, and emitting the superpressurized fire suppression composition to the fire. The method is particularly adapted for use in a total flooding system.

22 Claims, 1 Drawing Sheet

METHOD FOR DELIVERING A FIRE SUPPRESSION COMPOSITION TO A HAZARD

CROSS-REFERENCE TO RELATED APPLICATIONS

This application is a continuation of U.S. application Ser. No. 08/811,336, filed Mar. 4, 1997, now abandoned, which is a continuation of U.S. application Ser. No. 08/383,059, filed Feb. 3, 1995, now abandoned.

FIELD OF THE INVENTION

The present invention relates to the field of fire extinguishing compositions and methods for delivering fire extinguishing compositions to or within a protected hazard area.

DESCRIPTION OF THE PRIOR ART

Certain halogenated hydrocarbons have been employed as fire extinguishants since the early 1900's. Prior to 1945, the three most widely employed halogenated extinguishing agents were carbon tetrachloride, methyl bromide and bromochloromethane. For toxicological reasons, however, the use of these agents has been discontinued. Until only recently, the three halogenated fire extinguishing agents in common use were the bromine-containing compounds, Halon 1301 ($CF_3Br$), Halon 1211 ($CF_2BrCl$) and Halon 2402 ($BrCF_2CF_2Br$). One of the major advantages of these halogenated fire suppression agents over other fire suppression agents such as water or carbon dioxide is the clean nature of their extinguishment. Hence, the halogenated agents have been employed for the protection of computer rooms, electronic data processing facilities, museums and libraries, where the use of water, for example, can often cause more secondary damage to the property being protected than is caused by the fire itself.

Although the above named bromine and chlorine-containing compounds are effective fire fighting agents, those agents containing bromine or chlorine are asserted to be capable of the destruction of the earth's protective ozone layer. For example, Halon 1301 has an Ozone Depletion Potential (ODP) rating of 10, and Halon 1211 has an ODP of 3. As a result of concerns over ozone depletion, the production and sale of these agents after Jan. 1, 1994 is prohibited under international and United States policy.

The Halon agents Halon 1301 and Halon 1211 are employed both in total flooding applications, in which the entire facility being protected is filled with the agent following detection of a fire, and in streaming (also termed "portable") applications, in which a stream of the agent is directed at the fire source, typically from a hand-held or wheeled extinguisher (hence the term "portable").

Conventional fire suppression systems employing Halon 1301 or Halon 1211 utilize an agent storage cylinder fitted with a dip tube to afford delivery of the agent. At lower agent cylinder storage temperatures, the vapor pressure of the agent is reduced, and hence the driving force for expulsion of the agent from the dip tube is also reduced, leading to a longer discharge time for the agent delivery. Longer discharge times are undesirable as it is well known that longer discharge times lead to longer extinguishment times and hence increased fire damage and combustion product formation. In order to provide for a more rapid discharge and to allow for consistent system operation over a wide range of temperatures, Halon systems are superpressurized with an inert gas, typically nitrogen. For total flood applications, Halon 1301 is superpressurized with nitrogen to a total pressure of 360 psig at 70° F. Halon 1211 systems designed for streaming applications are superpressurized with nitrogen to 150 to 195 psig at 70° F.

The use of hydrofluorocarbons, for example 1,1,1,2,3,3,3-heptafluoropropane ($CF_3CHFCF_3$), as extinguishing agents has been proposed only recently, for example as described in U.S. Pat. No. 5,124,053. Since the hydrofluorocarbons do not contain bromine or chlorine, the compounds have no effect on the stratospheric ozone layer and their ODP is zero. As a result, hydrofluorocarbons such as 1,1,1,2,3,3,3-heptafluoropropane are currently being employed as environmentally friendly replacements for the Halons in fire suppression applications. This invention relates to the use of such Halon replacements.

Nitrogen superpressurization as described above for the Halons may also be employed with Halon replacement agents, for example with 1,1,1,2,3,3,3-heptafluoropropane. However, the use of nitrogen superpressurization with the new agents creates several problems that were not encountered in the case of the Halon agents. For example, the rate of dissolution of nitrogen into 1,1,1,2,3,3,3-heptafluoropropane is much slower than the rate of dissolution of nitrogen in Halon 1301, and hence the time required for the 1,1,1,2,3,3,3-heptafluoropropane/nitrogen system to come to equilibrium is much longer than that for the Halon 1301/nitrogen system. It is essential to know that the system has equilibrated in order to ensure proper operation, as an undercharged or overcharged system will not function properly. Slow nitrogen dissolution leads to increased time and hence cost when filling and superpressurizing 1,1,1,2,3,3,3-heptafluoropropane system cylinders, as more time must be allowed for the system to equilibrate between incremental addition of nitrogen to the 1,1,1,2,3,3,3-heptafluoropropane. The equilibration time can be shortened by vigorous agitation of the cylinder, but this again leads to increased costs of cylinder filling.

Further, the solubility of nitrogen in Halon replacement agents such as 1,1,1,2,3,3,3-heptafluoropropane is much greater than its solubility in Halon 1301. As a result, larger quantities of nitrogen are required to achieve the same level of superpressurization, e.g., 360 psig at 70° F. for total flooding applications. Additionally, greater departures from the equilibrium pressure occur when the replacement agent/nitrogen system is heated rapidly compared to the case of the Halon 1301/nitrogen system. When a nitrogen superpressurized liquid is heated rapidly, nitrogen comes out of solution in quantities such that the amount of nitrogen in the vapor phase is greater than the amount present in the vapor phase under equilibrium conditions, and a high pressure non-equilibrium condition is established. As the temperature stabilizes, the system slowly equilibrates and the pressure decreases to the equilibrium pressure corresponding to that temperature. For systems such as the 1,1,1,2,3,3,3-heptafluoro-propane/nitrogen system, the temporary, non-equilibrium pressures resulting from rapid heating of the cylinder can reach high levels, potentially exceeding the pressure rating of the equipment and creating a potential hazard.

An additional problem encountered with the practical use of the Halon replacement agents is that of retrofitting existing systems. For example, due to their differing transport properties and nitrogen solubility, the flow of superpressurized 1,1,1,2,3,3,3-heptafluoropropane in a given piping system is slower than that of superpressurized Halon 1301. Hence, in a system designed to provide a 30 second discharge of Halon 1301, a discharge time of greater than 30 seconds results when replacing the Halon 1301 system cylinder with a 1,1,1,2,3,3,3-heptafluoropropane system cylinder. As pointed out previously, shorter discharge times are desired in order to provide more rapid extinguishment and to reduce the amounts of combustion products formed. In order to achieve a discharge time of 30 seconds or less in an existing Halon 1301 system, replacement of the entire existing piping network may be required, adding significantly to the cost of system changeover.

A further problem associated with superpressurized Halon replacement agents concerns the ease of modeling their flow in piping networks. The flow of nitrogen superpressurized Halon 1301 is known to be a two-phase flow, and considerable effort was expended in the past to model the flow of nitrogen superpressurized Halon 1301 to allow the design of engineered systems. The flow of superpressurized Halon replacements is also two-phase, and in order to properly characterize and model their flow, considerable effort will be required.

SUMMARY OF THE INVENTION

Briefly describing one aspect of the present invention, there is provided a method for the delivery of a fire extinguishing agent to a fire. The method includes providing a container of the fire extinguishing agent and a source of high pressure gas. Immediately prior to delivery of the agent to the fire, the high pressure gas source is coupled with the container for the fire extinguishing agent, thereby providing a superpressurized agent for delivery to the fire. A system for delivery of a fire extinguishing agent to a fire is similarly provided.

It is an object of this invention to provide a method for eliminating the lengthy equilibration times which would exist for Halon replacements if used with the present methods of system cylinder filling wherein the cylinder is charged with the agent and subsequently superpressurized with nitrogen.

It is a further object of this invention to provide a method for eliminating the potential problem of high non-equilibrium pressures associated with the superpressurization of Halon replacement fire suppression agents.

It is a further object of this invention to provide a method for retrofitting existing systems with the Halon replacements without the need to replace existing piping networks.

It is a further object of this invention to provide a method for eliminating two phase flow of superpressurized Halon replacements to allow simplification of the modeling of agent flow in piping networks.

BRIEF DESCRIPTION OF THE DRAWING

The FIGURE is a schematic view of a fire suppression agent delivery system according to the present invention.

DESCRIPTION OF THE PREFERRED EMBODIMENTS

Figure 1:
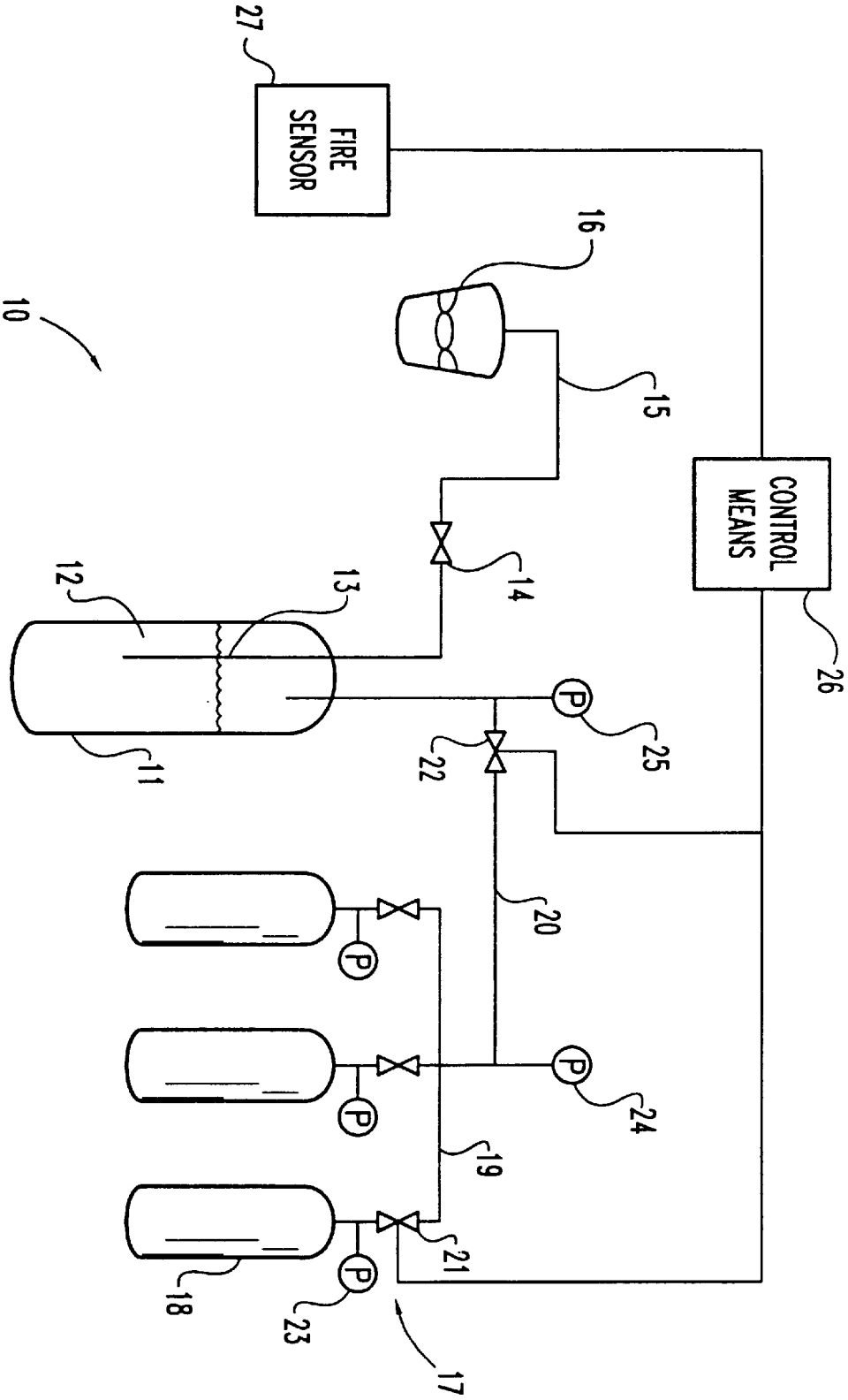

For the purpose of promoting an understanding of the principles of the invention, reference will now be made to preferred embodiments of the invention and specific language will be used to describe the same. It will nevertheless be understood that no limiation of the scope of the invention is thereby intended, such alterations, further modifications and applications of the principles of the invention as described herein being contemplated as would normally occur to one skilled in the art to which the invention relates.

In accordance with the present invention, it has been found that the superpressurization of a fire suppression agent immediately prior to system activation eliminates the above-described problems. As used herein, the term "superpressurize" is used to indicate that the fire suppression agent is raised to a pressure greater than its equilibrium pressure at the temperature of its storage container by the introduction of a separate pressurization gas.

In accordance with one embodiment of the present invention, there is provided a method for extinguishing fires which comprises a system consisting of a fire suppression agent stored in a suitable cylinder, and a pressurization system connected to the storage cylinder. The suppression agent is stored as the pure liquefied compressed gas in the storage cylinder under its own equilibrium vapor pressure at ambient temperatures. Upon detection of a fire, the suppression agent cylinder is superpressurized by suitable means, and once superpressurized to the desired level, the agent delivery is activated.

Storage of the suppression agent as the pure agent eliminates the problems associated with superpressurization. System cylinders may be filled rapidly and without agitation, as the cylinder pressure will always equal the vapor pressure of the agent at the ambient temperature. At the highest temperatures expected for cylinder exposure in typical applications, the vapor pressure of the neat agents is low compared to typical storage cylinder pressure ratings, and hence there is no need for concern about the development of excessive cylinder pressures as is the case for superpressurized agents.

A further desirable aspect of the present invention is that rapid superpressurization of the fire suppression agent immediately prior to system activation has been found to provide agent mass flow rates several times greater than that achievable from conventional, superpressurized systems. Hence much shorter discharge times arc possible employing the method of this invention compared to the prior art method of employing superpressurized agents. This allows the replacement of existing Halon systems with the new agents without the need for replacing existing piping networks. A further desirable aspect of the present invention is that by superpressurizing the agent immediately prior to discharge, essentially single phase flow of the agent occurs, greatly simplifying the modeling of the agent flow and hence the design of suppression systems.

Specific fire suppression agents useful in accordance with the present invention include compounds selected from the chemical compound classes of the hydrofluorocarbons, perfluorocarbons, hydrochlorofluorocarbons, and iodofluorocarbons.

Specific hydrofluorocarbons useful in accordance with the present invention include trifluoromethane ($CF_3H$), pentafluoroethane ($CF_3CF_2H$), 1,1,1,2-tetrafluoroethane ($CF_3CH_2F$), 1,1,2,2-tetrafluoroethane ($HCF_2CF_2H$), 1,1,1,2,3,3,3-heptafluoropropane ($CF_3CHFCF_3$), 1,1,1,2,2,3,3-heptafluoropropane ($CF_3CF_2CF_2H$), 1,1,1,3,3,3-hexafluoropropane ($CF_3CH_2CF_3$), 1,1,1,2,3,3-hexafluoropropane ($CF_3CHFCF_2H$), 1,1,2,2,3,3-hexafluoropropane ($HCF_2CF_2CF_2H$), and 1,1,1,2,2,3-hexafluoropropane ($CF_3CF_2CH_2F$).

Specific perfluorocarbons useful in accordance with the present invention include octafluoropropane ($C_3F_8$) and decafluorobutane ($C_4F_{10}$).

Specific hydrochlorofluorocarbons useful in accordance with the present invention include chlorodifluoromethane ($CF_2HCl$), 2,2-dichloro-1,1,1-trifluoroethane ($CF_3CHCl_2$) and 2-chloro-1,1,1,2-tetrafluoroethane (CF3CHFCl).

Specific iodofluorocarbons useful in accordance with the present invention include iodotrifluoromethane ($CF_3I$).

It is also an aspect of the present invention that combinations of the above mentioned agents may be employed to provide a blend having improved characteristics in terms of efficacy, toxicity and/or environmental safety.

The method of the present invention may be applied for the delivery of fire suppression agents in the variety of methods employed for the Halons, including application in a flooding system, portable system or specialized system. Suitable agent storage cylinders include those employed for the Halons or specialized systems, and in general are equipped with a dip tube to facilitate delivery of the agent.

Specific means of agent superpressurization useful in accordance with the present invention include pressurization by inert gases contained in an external cylinder bank, or other suitable means of pressurization as are known to those skilled in the art, for example the use of azide-based techniques as employed in automotive air bag systems. Specific inert gases useful in accordance with the present invention include nitrogen, argon and carbon dioxide.

The delay time between the start of agent superpressurization and the release of the pressurized agent can vary from fractions of a second to several minutes. The preferred delay time between the start of agent pressurization and pressurized agent release is between 1 and 60 seconds. Longer delay times result in higher agent pressurization levels and shorter discharge times.

Referring to the FIGURE, there is shown an agent delivery system in accordance with the present invention. The system 10 includes a storage cylinder 11 containing a fire suppression agent 12. Dip tube 13 extends from the cylinder and is coupled with valve 14. Piping 15 leads from the valve to one or more delivery nozzles 16.

A pressurized gas source 17 is coupled with the storage cylinder 11. In one embodiment, the gas source 17 comprises a plurality of cylinders 18 containing nitrogen under pressure. Each cylinder 18 is coupled through piping 19 and 20 to the storage cylinder 11. Valves 21 and 22 are included in the piping system to control gas flow, and pressure gauges 23–25 are used to assist in monitoring the system.

In operation, a control means 26 is used to operate the valves 21 and 22 in response to the sensing of a fire by a suitable fire sensor 27. Such sensing and controlling is conventional in the fire suppression art, and is used to detect the presence of a fire and then trigger the operation of the fire suppression system. In the present system, the sensing of a fire is used to open the valves 21 and 22 and deliver the pressurized gas to the storage cylinder. In turn the valve 14 is also opened and the fire suppression agent is delivered to the fire through nozzle 16.

The invention will be further described with reference to the following specific Examples. However, it will be understood that these Examples are illustrative and not restrictive in nature.

EXAMPLE 1

A test enclosure was constructed with internal dimensions of 11.25×19.25×11.83 ft. providing 2,562 $ft^3$ of floodable volume. It was constructed with two layers of 0.5 inch gypsum wallboard over 2×4 inch wood framing, and was equipped with five 2×3 ft. polycarbonate windows and a steel door with magnetized seals. Agent was stored in a Halon 1301 rated for 100 lb of agent fitted with a quarter-turn ball valve. The outlet of the cylinder was connected to a piping network constructed of 0.5 inch NPT schedule 40 pipe terminating at a pendant nozzle located in the center of the enclosure ceiling. The piping and nozzle were sized to provide a 30 second liquid runout of Halon 1301 at a concentration of 5.0% v/v.

Connected to the head space of the cylinder through a second quarter-turn ball valve was a bank of three high pressure nitrogen cylinders. Pressure transducers were installed to monitor the nitrogen bank pressure (the "pistoning" pressure) and agent cylinder pressure. An additional pressure transducer was located at the nozzle to allow the determination of the discharge time from the pressure vs. time plot.

The agent cylinder was charged with 87.5 lb of 1,1,1,2,3,3,3-heptafluoropropane and then superpressurized with nitrogen to a total pressure of 360 psig at 70° F. The cylinder was then connected to the pipe network, the instrumentation initialized and the agent released through the pipe network. From the pressure transducer output, the liquid runout time was found to be 36 seconds, corresponding to a mass flow rate of 2.43 lb m/sec. Additional details are shown in Table 1.

EXAMPLE 2

The procedure described in Example 1 was followed, with the exception that the 1,1,1,2,3,3,3,-heptafluoropropane was not superpressurized with nitrogen. The pressure of the nitrogen bank (the initial "pistoning pressure") was set to 360 psig and at time equal to zero the valve connecting the nitrogen bank and the agent cylinder was opened to allow pressurization of the agent. One second later, the valve connecting the cylinder to the pipe network was opened, delivering the agent. The total liquid runout was determined to be 20 seconds, corresponding to a mass flow rate of 4.36 lb m/sec.

This example demonstrates the increased mass flow rates attainable by pressurizing the agent immediately before release. Additional details are shown in Table 1.

EXAMPLE 3

The procedure of Example 2 was repeated except the nitrogen bank pressure (the pistoning pressure) was set to an initial pressure of 600 psig. The resulting mass flow rate was 5.15 lb m/sec.

EXAMPLE 4

The procedure of Example 2 was repeated except that the delay time between pressurization and agent release was increased to 10 seconds. The resulting mass flow rate was 6.26 lb m/sec.

EXAMPLE 5

The procedure of Example 4 was repeated except that the nitrogen bank was set at an initial pressure of 775 psig. The resulting mass flow rate was 7.96 lb m/sec.

The above examples demonstrate the increased mass flow rates attainable by pressurizing the fire suppression agent immediately prior to system discharge.

TABLE 1

| Nitrogen Bank Pressure (psig) | Pressurization Times(s) | Max. Nozzle Pressure (psig) | Ave. Nozzle Pressure (psig) | Liquid Runout Time(s) | Mass Flow Rate (lbs/sec) | Example |
|---|---|---|---|---|---|---|
| 0* | — | 150 | 125 | 36 | 2.43 | 1 |
| 360 | 1 | 220 | 85 | 20 | 4.38 | 2 |
| 600 | 1 | 300 | 120 | 17 | 5.15 | 3 |
| 600 | 10 | 300 | 160 | 14 | 6.26 | 4 |
| 775 | 5 | 500 | 250 | 11 | 7.96 | 5 |

*FM-200 ™ superpressurized to 360 psig at 70° F. (conventional system).

EXAMPLE 6

Repeating the foregoing examples with variation of the indicated parameters within the scope of the present invention also provides desirable results. Use of alternate pressurization gases such as argon and carbon dioxide provides similar results. Variation of the initial gas pressures yields acceptable delivery of the fire suppression agents, with such variation permitting control over the delivery times and rates. The various other Halon and Halon replacement suppression agents described previously are suitably delivered in accordance with the foregoing examples.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for delivering an extinguishing composition consisting essentially of a liquid fire suppression agent selected from the group consisting of trifluoromethane ($CF_3H$), pentafluoroethane ($CF_3CF_2H$), 1,1,1,2-tetrafluoroethane ($CF_3CH_2F$), 1,1,2,2-tetrafluoroethane ($HCF_2CF_2H$), 1,1,1,2,3,3,3-heptafluoropropane ($CF_3CHFCF_3$), 1,1,1,2,2,3,3-heptafluoropropane ($CF_3CF_2CF_2H$), 1,1,1,3,3,3-hexafluoropropane ($CF_3CH_2CF_3$), 1,1,1,2,3,3-hexafluoropropane ($CF_3CHFCF_2H$), 1,1,2,2,3,3-hexafluoropropane ($HCF_2CF_2CF_2H$), 1,1,1,2,2,3-hexafluoropropane ($CF_3CF_2CH_2F$), octafluoropropane ($C_3F_8$), decafluorobutane ($C_4F_{10}$), chlorodifluoromethane ($CF_2HCl$), 2,2-dichloro-1,1,1-trifluoroethane ($CF_3CHCl_2$), 2-chloro-1,1,1,2-tetrafluoroethane ($CF_3CHFCl$), and iodotrifluoromethane ($CF_3I$) to a fire with an expellant consisting essentially of a separate pressurized inert gas with control over delivery time and delivery rate while flooding the area of the fire, which comprises the steps of:

(a) storing the fire suppression agent in an unpressurized condition in a first storage container;

(b) storing said inert pressurized gas in a second storage container;

(c) less than about 60 seconds prior to desired delivery of the fire suppression agent to the fire, coupling the first storage container to the second storage container to communicate the pressurized gas into the first storage container and thereby superpressurize the liquid fire suppression agent within the first storage container; and (d) emitting the superpressurized fire suppression agent from the first storage container to the fire.

2. The method of claim 1 in which said coupling comprises coupling the first storage container to the second storage container between about 1 and about 60 seconds before said emitting.

3. The method of claim 2 in which said coupling is between about 5 and about 10 seconds before said emitting.

4. The method of claim 1 in which said storing of the fire suppression agent comprises storing an agent selected from the group consisting of trifluoromethane ($CF_3H$), pentafluoroethane ($CF_3CF_2H$), 1,1,1,2,3,3,3-heptafluoropropane ($CF_3CHFCF_3$), 1,1,1,3,3,3-hexafluoropropane ($CF_3CH_2CF_3$), and iodotrifluoromethane ($CF_3I$).

5. The method of claim 1 in which said storing of the fire suppression agent comprises storing in the first storage container a composition consisting essentially of the fire suppression agent.

6. The method of claim 5 in which said storing comprises storing in the first storage container a composition consisting of the fire suppression agent.

7. The method of claim 1 in which said storing of said pressurized gas comprises storing said gas wherein said gas is selected from the group consisting of argon, nitrogen, and carbon dioxide.

8. The method of claim 1 in which said emitting comprises discharging the superpressurized fire suppression agent from a total flooding system connected with the first storage container.

9. The method of claim 1 in which said emitting comprises emitting the superpressurized liquid fire suppression agent from the first storage container, through piping, through a delivery nozzle, and to the fire.

10. A method for delivering a fire extinguishing composition consisting essentially of a liquid fire suppression agent selected from the group consisting of trifluoromethane ($CF_3H$), pentafluoroethane ($CF_3CF_2H$), 1,1,1,2-tetrafluoroethane ($CF_3CH_2F$), 1,1,2,2-tetrafluoroethane ($HCF_2CF_2H$), 1,1,1,2,3,3,3-heptafluoropropane ($CF_3CHFCCF_3$), 1,1,1,2,2,3,3-heptafluoropropane ($CF_3CF_2CF_2H$), 1,1,1,3,3,3-hexafluoropropane ($CF_3CH_2CF_3$), 1,1,1,2,3,3-hexafluoropropane ($CF_3CHFCF_2H$), 1,1,2,2,3,3-hexafluoropropane ($HCF_2CF_2CF_2H$), 1,1,1,2,2,3-hexafluoropropane ($CF_3CF_2CH_2F$), octafluoropropane ($C_3F_8$), decafluorobutane ($C_4F_{10}$), chlorodifluoromethane ($CF_2HCl$), 2,2-dichloro-1,1,1-trifluoroethane ($CF_3CHCl_2$), 2-chloro-1,1,1,2-tetrafluoroethane ($CF_3CHFCl$), iodotrifluoromethane ($CF_3I$), and combinations thereof to a fire with a separate pressurized inert gas consisting of the steps of:

(a) storing the fire suppression agent in an unpressurized condition in a first storage container;

(b) storing said pressurized inert gas in a second storage container;

(c) less than about 60 seconds prior to desired delivery of the fire suppression agent to the fire, coupling the first storage container to the second storage container to communicate said pressurized inert gas into the first storage container and thereby superpressurize the fire suppression agent within the first storage container; and (d) emitting the superpressurized fire suppression agent from the first storage container to the fire.

11. The method of claim 10 in which said coupling comprises coupling the first storage container to the second storage container between about 1 and about 60 seconds before said emitting.

12. The method of claim 11 in which said coupling is between about 5 and about 10 seconds before said emitting.

13. The method of claim 11, wherein the fire suppression agent is selected from the group consisting of 1,1,1,2,3,3,3-heptafluoropropane ($CF_3CHFCF_3$); 1,1,1,3,3,3-hexafluoropropane ($CF_3CH_2CF_3$); 1,1,1,2-tetrafluoroethane ($CF_3CH_2F$); and combinations thereof.

14. The method of claim 13, wherein the fire suppression agent is 1,1,1,2,3,3,3-heptafluoropropane ($CF_3CHFCF_3$).

15. The method of claim 13, wherein the fire suppression agent is delivered without first equilibrating the fire suppression agent and pressurized gas, and without agitation of the first storage container.

16. The method of claim 15, wherein the pressurized gas comprises nitrogen.

17. The method of claim 10 in which said storing of the fire suppression agent comprises storing an agent selected from the group consisting of trifluoromethane ($CF_3H$), pentafluoroethane ($CF_3CF_2H$), 1,1,1,2,3,3,3-heptafluoropropane ($CF_3CHFCF_3$), 1,1,1,3,3,3-hexafluoropropane ($CF_3CH_2CF_3$), and iodotrifluoromethane ($CF_3I$).

18. The method of claim 10 in which said storing of the fire suppression agent comprises storing in the first storage container a composition consisting essentially of the fire suppression agent.

19. The method of claim 18 in which step (a) comprises storing in the first storage container a composition consisting of the fire suppression agent.

20. The method of claim 10 in which said storing of said pressurized gas comprises storing a gas selected from the group consisting of argon, and nitrogen.

21. The method of claim 10 in which said emitting comprises discharging the superpressurized fire suppression agent from a total flooding system connected with the first storage container.

22. The method of claim 10 in which said emitting comprises emitting the superpressurized liquid fire suppression agent from the first storage container, through piping previously used to deliver Halon, and through a nozzle to a fire.

* * * * *

UNITED STATES PATENT AND TRADEMARK OFFICE

CERTIFICATE OF CORRECTION

PATENT NO. : 6,112,822
DATED : September 5, 2000
INVENTOR(S) : Robin et al.

It is certified that error appears in the above-identified patent and that said Letters Patent is hereby corrected as shown below:

Column 8,
Line 65, delete "($CF_3CHFCCF_3$)," and substitute therefor -- ($CF_3CHFCF_3$) --.

Signed and Sealed this

First Day of January, 2002

*Attest:*

*Attesting Officer*

JAMES E. ROGAN
*Director of the United States Patent and Trademark Office*